United States Patent [19]

Minick

[11] 4,146,444

[45] Mar. 27, 1979

[54] METHOD FOR PREHEATING A MOLTEN SALT ELECTROLYSIS CELL

[75] Inventor: John R. Minick, Upper Burrell Township, Westmoreland County, Pa.

[73] Assignee: Aluminum Company of America, Pittsburgh, Pa.

[21] Appl. No.: 895,089

[22] Filed: Apr. 10, 1978

[51] Int. Cl.[2] ..... C25C 3/00; C25C 3/06

[52] U.S. Cl. ..... 204/67; 204/64 R

[58] Field of Search ..... 204/64 R, 67

[56] References Cited

U.S. PATENT DOCUMENTS 4,071,420 1/1978 Foster et al. ..... 204/67

FOREIGN PATENT DOCUMENTS 360506 4/1962 Switzerland ..... 204/67

*Primary Examiner*—Howard S. Williams

*Attorney, Agent, or Firm*—David J. Hill

[57] ABSTRACT

A method is disclosed for preheating a molten salt electrolysis cell having an electrode which includes at least one element protruding into the interior of the cell. The method disclosed includes the distribution of a carbonaceous aggregate around such an element, and the ignition of this aggregate, so that the element may be brought to an elevated temperature without breaking due to the effects of thermal gradients.

6 Claims, 2 Drawing Figures

METHOD FOR PREHEATING A MOLTEN SALT ELECTROLYSIS CELL

BACKGROUND OF THE INVENTION

This invention is directed to a method for preheating a molten salt electrolysis cell so as to avoid early failure of protruding electrode elements of such a cell due to the effects of thermal gradients encountered.

The invention may be employed in connection with electrolytic reduction cells used in the production of aluminum. Such cells may operate by electrolytically reducing alumina to aluminum.

A conventional cell of this type usually includes a thermally insulated steel box lined with blocks of carbon cemented together with a carbon paste. Alternatively, the cell lining may be of the monolithic variety, which consists of a rammed mixture of finely ground carbon and pitch. The carbon floor of the cell transmits electrical current from a molten pad of aluminum which serves as the cathode surface; the anode surface is provided by carbon blocks suspended from above.

In operation, the conventional cell contains an electrolytic, molten cryolite-based bath in which alumina is dissolved. A crust of frozen electrolyte and alumina forms on top of the bath and around the anode blocks. As electrical current passes through the bath between the anode and cathode surfaces, alumina is reduced to aluminum, which is deposited in the pad of molten metal.

Electrolytic reduction cells must be heated from room temperature to approximately the desired operating temperature before the production of metal can be initiated. For cells used in the reduction of aluminum from alumina, the desired operating temperature is usually in the range of 900°–1000° C. The heating operation may be employed to bake monolithic linings or to bake the carbon paste seam cement where prebaked carbon blocks are employed. In addition, heating prior to operation is necessary to minimize thermal shock to the lining upon introduction of the electrolyte and molten metal to the cell.

In the case of conventional reduction cells having a monolithic lining, the initial heating operation must include a preliminary baking step. It has been known to bake these linings by building a wood fire in the cell. This method of baking has the advantage of allowing baking of the lining to proceed while driving off and even burning the volatile components of the pitch in the lining mixture. Other baking methods have involved an attempt at baking the monolithic linings by means of "resistance heating" methods, such as are commonly employed to heat reduction cells to the desired operating temperature.

One such resistance heating method, useful in the heating of a conventional reduction cell to its desired operating temperature, is set forth in Tilson's U.S. Pat. No. 1,572,253. This method involves lowering the carbon anodes into contact with the carbon floor, and then passing a flow of current from the anode through the cathode and out of the cell through the cathode connector terminals. According to this method, the flow of current through the "high resistance encountered at the points of contact" between the anodes and the carbon floor causes "rapid and great evolution of heat at such points."

It is also known to heat a conventional cell by passing electrical current through a layer of carbon particles interposed between the anode blocks and the carbon floor of the cell. Such a heating method is discussed in British Pat. No. 1,046,705, of the British Aluminium Company, Limited. This method calls for a one to two inch layer of carbon particles to be placed on the carbon floor. The anode blocks are then lowered to contact this layer, and current is passed through the particles to the carbon floor.

Although these known methods of heating molten salt electrolysis cells may provide satisfactory results in preparing conventional cells for operation, they are not suitable for low temperature heating of the improved cell contemplated by this invention.

Such a cell is described in U.S. Pat. No. 4,071,420, of Foster et al., issued on Jan. 31, 1978. This cell accommodates the electrolysis, between anodic and cathodic surfaces, of a compound of a metal such as aluminum dissolved in a molten solvent. In the case of the electrolysis of alumina, the molten solvent may be cryolite-based. The electrolysis is performed at a temperature such that the metal is formed in the molten state, and the metal thus formed collects in a molten metal pad. In one embodiment, the cathode of this cell is provided in the form of an array of elements that protrudes out of the metal pad into the solvent toward the anode. There is thus established a series of locations at which the distance between the anode and cathode surfaces is preferably less than or equal to $1\frac{1}{4}$ inches, thereby providing for more advantageous operation of the cell.

The cathode elements of the cell of Foster et al. are preferably made from sintered composites of refractory hard metals, such as, for example, titanium diboride ($TiB_2$). These elements survive the conditions of cell operation very well once the desired operating temperature is reached, but they are somewhat sensitive to damage caused by thermal gradients encountered at relatively low temperatures. The temperature above which the elements are less sensitive to thermal gradients is not easily calculated, because it varies, depending upon the physical properties of the material of which the elements are made, the size and shape of the elements, the placement of elements in the cell, the shape of the cell itself, and the rate at which the cell is heated.

The known methods of heating an electrolysis cell, involving the passage of current from the anode directly to the carbon floor or through an interposed layer of carbon particles to the floor, are unsuitable for heating the cell of Foster et al. until the cell has been raised to an elevated temperature. When employed to heat this cell at relatively low temperatures, these resistance heating methods produce localized "hot spots" on the surfaces of the cathode elements nearest the anode unless carried out at very low heating rates over a long period of time. This uneven heating of the elements may lead to thermal shock breakage or spalling.

This damage may occur in the following manner. At relatively low temperatures, during heating of the elements by resistance methods at commercially practical heating rates, the surfaces nearest the anode are heated more rapidly than other portions of the elements. This may be due to the fact that the small surface area of the elements near the anode relative to the area of the cell floor leads to the development of higher current densities near those areas. In any event, during resistance heating of the elements at low temperatures, a large nonlinear temperature gradient develops between the surfaces of the elements nearest the anode and those surfaces farthest away. This gradient causes differential expansion of the elements, giving rise to differential stresses. When such stresses exceed the strength of the elements, cracking may occur at varying distances from the anode. Severe cracks may cause portions of the elements to break away. Obviously, the performance of a severely cracked or spalled element is substantially poorer than the performance of a similar, undamaged element. In addition, an element damaged by spalling tends to wear faster than an undamaged element. In fact, such a damaged element may completely disintegrate during cell operation.

Because of the problem of spalling that occurs when protruding refractory hard metal electrode elements are heated by conventional resistance methods, the British Aluminium Company has developed a modified resistance heating method for use in connection with cells employing such elements. This modified method, which is described in the aforementioned British Pat. No. 1,046,705, involves passing a flow of current from a carbon electrode which is intended to function as an anode during normal cell operation, through a carbonaceous resistance heating material, to another electrode which is intended likewise to function as an anode during normal cell operation.

SUMMARY OF THE INVENTION

It is an object of the present invention to provide a method for preheating a molten salt electrolysis cell having an electrode which includes at least one element protruding into the interior of the cell. It is a further object of the invention to provide a method for preheating such a cell to an elevated temperature in a manner so as to avoid early failure of the elements due to the effects of thermal gradients encountered. Another object of the invention is to provide a method for preheating such a cell at a moderate, even rate, so as to avoid damage to such electrode elements by spalling.

In accordance with these and other objects, a method is disclosed for preheating such a cell by distributing a carbonaceous aggregate around at least one such electrode element, and igniting this aggregate, so that the element may be brought to an elevated temperature without breaking due to the effects of thermal gradients.

In order to facilitate an understanding of the invention, reference is made to the embodiment shown in the accompanying drawings, and detailed descriptive language is employed. It should be understood nevertheless that it is not intended that the invention be limited to the particular embodiment shown. Various changes and alterations are contemplated such as would ordinarily occur to one skilled in the art to which the invention relates.

DETAILED DESCRIPTION OF THE INVENTION

Figure 1:
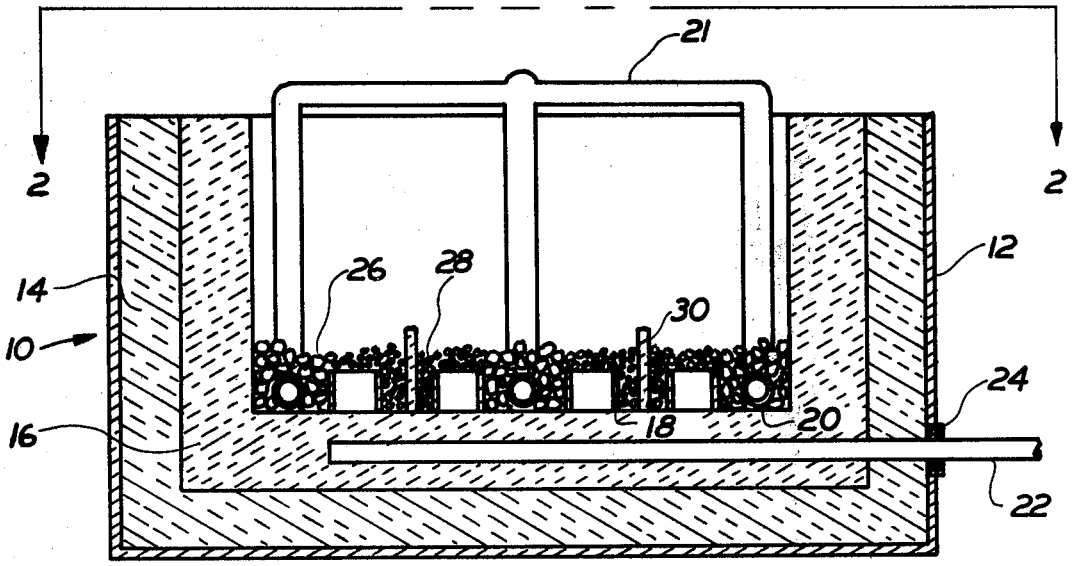
FIG. 1 is a schematic elevation in cross section taken on the line 1—1 of FIG. 2 of a cell utilizing one embodiment of a method of the invention.
Figure 2:
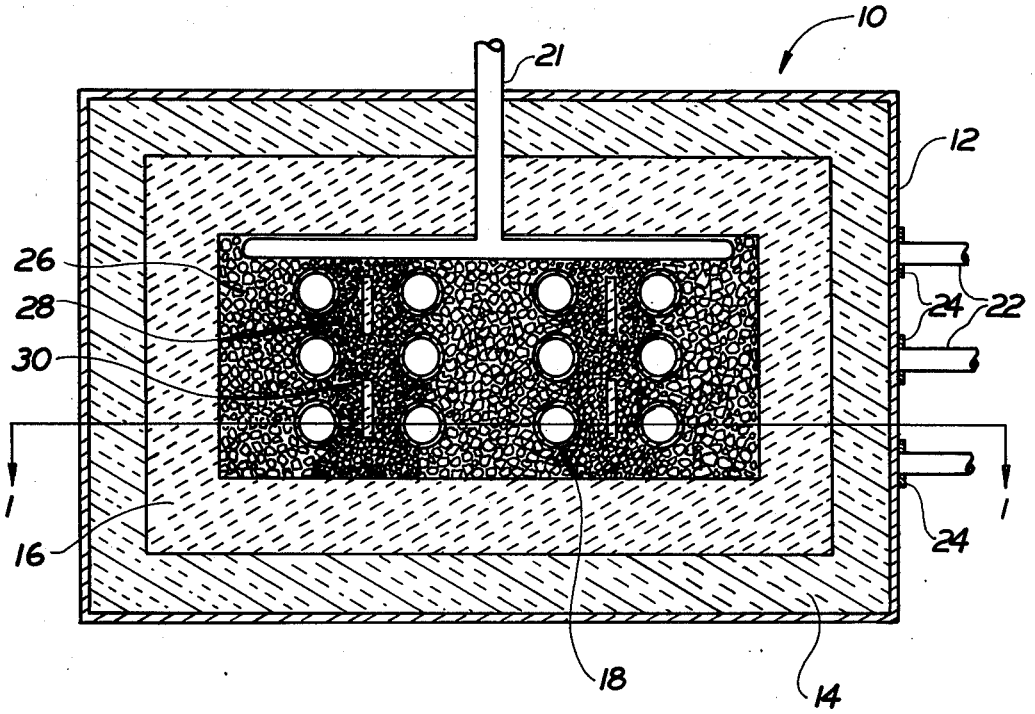
FIG. 2 is a cross-sectional view taken on the line 2—2 of FIG. 1.

The methods of the present invention may be practiced in a molten salt electrolysis cell such as is illustrated in FIGS. 1 and 2. The cell 10 is an embodiment of the improved cell of Foster et al., referred to above. It has a metal shell 12 enclosing a thermally insulative liner 14 and an internal carbon layer 16. In the drawings, the anodes are omitted for ease of illustration, and cathode elements 18 are shown protruding out of carbon layer 16. These elements, as shown in FIG. 2, may be in the shape of hollow pipes, arrayed in parallel rows. It should be understood, however, that the invention may be practiced in connection with a cell having any of several different element configurations and arrangements, such as those discussed in the aforementioned patent of Foster et al.

Furthermore, it should be noted that the preferred embodiment disclosed here is not critical to the broader concept of the invention. For instance, the intended polarity and orientation of the electrode elements is not critical to the practice of the invention. Thus, for example, the methods of this invention may be practiced in a cell having electrode elements protruding at any convenient angle into the interior of the cell.

Referring to the embodiment pictured in FIGS. 1 and 2, cathode collector bars 22 extend from carbon layer 16 through insulative liner 14 and metal shell 12 to the outside of the cell. At the point where collector bars 22 pass through metal shell 12, electrical insulation 24 is provided.

In the practice of this invention, the temperature in the cell is raised to a temperature higher than that below which the deleterious effects of thermal gradients are manifest for elements 18. This is accomplished by distributing a carbonaceous aggregate around electrode elements 18 and igniting the aggregate.

Any form of relatively high purity carbon may be employed as the aggregate, such as coal, coke or charcoal. Ordinary household charcoal briquettes have been found to give superior results at a moderate cost. The size of the aggregate constituents is not critical, so long as the aggregate may be distributed more or less uniformly around the elements. It is preferred that the aggregate be provided in sufficient quantity to completely cover the elements. Referring again to FIGS. 1 and 2, charcoal briquettes 26 are shown surrounding the array of elements 18 and crushed briquettes 28 are shown between adjacent elements 18. Crushed briquettes may be placed within the interior of the elements 18, but a representation of this has been omitted in the drawings for the sake of clarity. Similarly, the portion of the aggregate that covers the elements has been omitted in FIG. 2.

Ignition and burning of the aggregate may be facilitated by the provision of air or oxygen through ducts 20 from manifold 21. Ease in igniting the aggregate may also be enhanced by the distribution of a flammable liquid, such as household charcoal lighter fluid, over the aggregate before ignition is effected. In this way, the electrode elements are brought to an elevated temperature at an even, moderate rate.

Because of the difficulty in adapting thermal shock theories to actual operating conditions, it is quite difficult to predict a "critical temperature" for a particular electrode element, below which temperature the deleterious effects of thermal gradients are manifest. Further complicating the application of these theories are the restrictive assumptions made in their development. The complexity of the mathematics involved restricts the theories' application to simple geometrical shapes, steady-state heat flux and idealized materials. But the heat flux involved in resistance heating is hardly steady-state, and the strength and other properties of refractory hard metals may be easily altered by fabrication techniques and handling. In addition, the geometric variation possible in the elements further contributes to the difficulty in predicting a critical temperature.

Because of the difficulties involved in predicting this critical temperature, it is recommended that a series of simple tests be carried out to determine the temperature level to which the method of the invention should be utilized to heat the particular elements contemplated for use in a cell in order to avoid the deleterious effects of thermal gradients. Such tests may be carried out in a bench scale cell such as is depicted in Foster et al. The tests should involve the choosing of an arbitrary temperature level, the preheating of the cell to this level by the method of the invention, and the continued heating of the cell to operating temperature by the resistance method. The proper temperature level to which the method of the invention should be practiced for particular elements in a particular cell array will likely be easily determinable in a few such trials. Once this elevated temperature has been reached, known heating methods, such as resistance methods, may be employed without danger. At elevated temperatures, the elements are not as susceptible to spalling or cracking, and the cell may be raised to operating temperature by previously known heating methods, without damage occurring in the elements due to thermal gradients encountered.

Further illustrative of the present invention is the following example.

A cell such as the one pictured in FIGS. 1 and 2 was preheated according to the invention. The cathode elements of the cell were cylindrical pipes of $TiB_2$ manufactured by PPG Industries, that extended 2 to 4 inches above the floor of carbon layer 16. For such elements, experience has shown that the method of the invention should be practiced until a temperature of about 500° C. has been reached.

Carbon resistor blocks 30, measuring about ¾ inch × 4 inches × 6 inches, were placed in the array of cathode elements, resting on the floor provided by carbon layer 16, as shown in FIGS. 1 and 2. These resistor blocks were similar in composition and physical characteristics to the prebaked carbon blocks often used in cell linings. They would be used in the resistance heating step that would raise the temperature of the cell from that attained by charcoal preheating to operating temperature.

About 400 pounds of charcoal briquettes, manufactured under the trademark "Kingsford" by the Kingsford Company of California, were evenly distributed in the bottom of the cell. Whole briquettes, measuring about 2 inches × 2 inches × 1 inch were placed around the periphery of the array of elements. Crushed briquettes, measuring about ½ to 1 inch mesh were placed between the elements. The cell was filled with charcoal to a depth of about 5 to 6 inches, so that the elements were completely covered.

About two pints of household charcoal lighter fluid, manufactured under the trademark "Gulflite" by Gulf Oil Corporation, were distributed evenly over the charcoal briquettes. The briquettes were then ignited, and air was pumped through ducts 20 into the bed of charcoal throughout its burning. The air was pumped at a rate of 30 scfm (standard cubic feet per minute). As the charcoal was consumed, additional amounts were added to maintain a relatively constant depth in the cell. The total amount of charcoal used in the preheating operation was about 700 pounds. The temperature in the cell rose at a relatively constant rate of about 130° C. per hour from room temperature, about 25° C., to a temperature of 550° C. This preheating took about four hours.

After this preheating was accomplished, the anodes were lowered into contact with the resistor blocks to heat the cell to operating temperature (about 900° C.) by a resistance method, by passing electrical current from the anode, through the resistor blocks, to the carbon floor of the cell. The majority of the coals from the charcoal fire and the resistor blocks were then removed, and the cell was filled with a bath of composition, in weight percent, as follows: 79% cryolite, 11% $AlF_3$, 6% $CaF_2$ and 4% $Al_2O_3$. The cell was operated to produce aluminum for 90 days, then shut down and drained. An examination of the cathode elements showed no damage such as had previously been encountered when resistance heating methods had been employed to raise the cell from room temperature to operating temperature.

It should be understood that the above description of the present invention is susceptible to various modifications, changes and adaptations, and the same are intended to be comprehended within the meaning and range of equivalents of the appended claims.

What is claimed is:

1. A method for preheating a molten salt electrolysis cell having an electrode comprising at least one element protruding into the interior of the cell, wherein the improvement comprises providing a carbonaceous aggregate around such element, and igniting the aggregate for elevating the temperature of the element.

2. The method of claim 1, wherein a flammable liquid is distributed in the aggregate before the ignition thereof.

3. The method of claim 1, wherein a flow of air is provided in the aggregate during the ignition and burning thereof.

4. The method of claim 1, wherein the cell includes an internal carbon layer, and said electrode is a cathode, the element of which protrudes from the carbon layer.

5. The method of claim 4, wherein the aggregate comprises charcoal.

6. A method for preheating a molten salt electrolysis cell including an internal carbon layer and a number of elements protruding from the carbon layer into the interior of the cell, wherein the improvement comprises providing a carbonaceous aggregate around said elements, distributing a flammable liquid in the aggregate, igniting the aggregate, and providing a flow of air in the aggregate to aid ignition and burning, whereby the elements are elevated in temperature.

* * * * *